US008905275B1

(12) United States Patent
Klein

(10) Patent No.: US 8,905,275 B1
(45) Date of Patent: Dec. 9, 2014

(54) ALPINE SKI AND SNOWBOARD CARRYING DEVICE

(76) Inventor: Ron L. Klein, Telluride, CO (US)

( * ) Notice: Subject to any disclaimer, the term of this patent is extended or adjusted under 35 U.S.C. 154(b) by 692 days.

(21) Appl. No.: 12/751,988

(22) Filed: Mar. 31, 2010

Related U.S. Application Data

(60) Provisional application No. 61/168,685, filed on Apr. 13, 2009.

(51) Int. Cl.
*A45F 3/14* (2006.01)

(52) U.S. Cl.
USPC ..... 224/259; 224/250; 224/917

(58) Field of Classification Search
USPC ..... 224/250, 257–259, 580, 624, 625, 651, 224/917; 294/147, 157
See application file for complete search history.

(56) References Cited

U.S. PATENT DOCUMENTS

| | | | | | |
|---|---|---|---|---|---|
| 2,715,989 | A | * | 8/1955 | Sjodin et al. | 224/624 |
| 4,463,885 | A | * | 8/1984 | Ball et al. | 224/250 |
| 4,751,923 | A | * | 6/1988 | Marino | 602/4 |
| 5,350,096 | A | * | 9/1994 | Sieber | 224/586 |
| 5,383,587 | A | * | 1/1995 | Carpenter | 224/257 |
| 5,400,937 | A | * | 3/1995 | Rottenberg | 224/258 |
| 5,427,291 | A | | 6/1995 | Smith | |
| 5,647,522 | A | * | 7/1997 | Routh | 224/651 |
| 5,664,721 | A | * | 9/1997 | Homeyer | 224/651 |
| 5,803,332 | A | * | 9/1998 | Thompson | 224/651 |

* cited by examiner

*Primary Examiner* — Brian D Nash
*Assistant Examiner* — Corey Skurdal
(74) *Attorney, Agent, or Firm* — Crossley Patent Law

(57) ABSTRACT

A lightweight and compact alpine ski and snowboard carrying device which supports a pair of alpine skis and, in the alternative, a snowboard, in a vertical position along a user's back and which rolls up for storage in a pocket, along with a method for using the present device.

6 Claims, 6 Drawing Sheets

ALPINE SKI AND SNOWBOARD CARRYING DEVICE

I claim benefit of my US Provisional Patent Application No. 61/168,685 filed Apr. 13, 2009.

BACKGROUND OF THE INVENTION

Various types of alpine ski accessories are known in the prior art. However, what is needed is a lightweight and compact alpine ski and snowboard carrying device which supports a pair of alpine skis and, in the alternative, a snowboard in a vertical position along a user's back and which rolls up for storage in a pocket, along with a method for using the present device.

FIELD OF THE INVENTION

The present invention relates to alpine ski accessories, and more particularly, to a lightweight and compact adjustable alpine ski and snowboard carrying device which supports a pair of alpine skis or, in the alternative, a snowboard, in a balanced vertical position along a user's back and which rolls up for storage in a ski jacket pocket, along with a method for using the present device.

SUMMARY OF THE INVENTION

The general purpose of the present alpine ski and snowboard carrying device, described subsequently in greater detail, is to provide an alpine ski and snowboard carrying device which has many novel features that result in an alpine ski and snowboard carrying device which is not anticipated, rendered obvious, suggested, or even implied by prior art, either alone or in combination thereof.

To accomplish this, the present alpine ski and snowboard carrying device includes a slidingly adjustable supporting first strap, a longer adjustable supporting second strap slidably connected to the first strap, an adjustable first end strap attached to the first strap and an adjustable second end strap attached to an adjustable supporting second strap, the first end strap wrapping around and below the toe piece of a ski binding, also referred to herein as the forward binding of a snowboard, and secured with hook and loop fastening disposed on opposite distal ends thereof and the second end strap wrapping around and below the heel piece of the ski binding, also referred to herein as the rearward binding of a snowboard, and secured with hook and loop fastening disposed on opposite distal ends thereof, the device carrying a pair of alpine skis or, in the alternative, a snowboard, with the first strap and the second strap worn over a user's shoulders and the pair of alpine skis supported in a vertical position along a user's back. An elongated extension member formed of hook and loop fastening attaches to the securement portion of each of the first end strap and the second end strap to extend the length of the securement portion for utilization of the device to carry a snowboard. The device may also be compactly rolled up for storage in a pocket.

The instant alpine ski and snowboard carrying device may be re-used an unlimited number of times and is adjustable to accommodate alpine skis and snowboards of varying lengths and widths. The present device is lightweight and compact for easy storage in a pocket. Alternative embodiments of the device utilize different configurations and lengths of straps, but generally incorporate the same concept. The present device is made of lightweight nylon webbing and heavy duty plastic slider-type buckles, and may also include hook and loop fasteners. The present device is very easy to use. The present device holds alpine skis and, in the alternative, a snowboard securely upon a user's back, which allows for better balance than other alpine ski and snowboard carrying devices. The present device keeps a user's hands free which, in turn, allows the user to use ski poles while walking and hiking. The components of the present device are less expensive than components of other alpine ski and snowboard carrying devices. The present device is less cumbersome than many other ski and snowboard carrying devices, such as a backpack. The straps are flexible resulting in a device which does not have hard and bulky components thus permitting the device to be carried in a pocket.

A preferred embodiment of the present device provides supporting first strap and supporting second strap, each formed of 1½ inch nylon webbing. Each of slider-type buckles has a height of 1½ inches and may be formed of high density plastic. The first end and second straps are formed of 1-inch nylon webbing. The first strap may have a length in a range from 23 inches to 26 inches and the second strap may have a length in a range from 62 inches to 68 inches. The first end strap has a length of 18 inches and the second end strap may have a length of 16 inches. Each securement portion has a length in a range of 5 to 7 inches.

Whether walking from the parking lot to the ski lift, or hiking into the backcountry skiing and snowboarding areas, the present alpine ski and snowboard carrying device allows a user to easily carry his alpine skis, or snowboard, on his back in a balanced, safe, and secure manner with his hands free which in turn allows the user to use ski poles while walking or hiking thereby helping to prevent slips and falls when walking on snowy or icy terrain.

Another version of the present device utilizes a solitary supporting first strap with a tie strap on opposite top and bottom ends and a clip attached to an outer end of the first strap. The first strap and tie straps may be constructed of one-inch nylon webbing and the clip may be constructed of metal. This version uses the same method as the preferred embodiment except that the toe piece and heel piece of the bindings are secured onto the device using the tie straps. Then the tightness of the first strap is adjusted using the clip to place the pair of skis into carrying position.

Yet another version of the present device replaces the first end strap and second end strap of the preferred embodiment with an upper strap and a lower strap, each of which has a pressure-release buckle secured to the ends. This version may utilize one and one-half-inch nylon webbing for the upper and lower straps, two 1½" plastic pressure-release clips, two 1" pressure-release clips disposed on the upper and lower straps and 1" nylon webbing for the upper strap and lower strap.

Still another version of the present device replaces each high-density plastic slider-type buckle of the preferred embodiment with a non-high-density plastic.

Even another embodiment of the present device replaces each high-density plastic slider-type buckle of the preferred embodiment with a non-high-density plastic slider-type buckle and the first end and second end straps have double-sided securement portions in that each distal end of the first and second end straps have hook and loop fastening on both a front side and a rear side of each of the straps.

Even still another embodiment replaces the slider-type buckle of the preferred embodiment with clips formed of metal and having a length of 2½", a securement portion having a length of 5" on each distal end of the first end and second end straps.

Thus has been broadly outlined the more important features of the present alpine ski and snowboard carrying device so that the detailed description thereof that follows may be better understood and in order that the present contribution to the art may be better appreciated.

Numerous objects, features and advantages of the present alpine ski and snowboard carrying device will be readily apparent to those of ordinary skill in the art upon reading the following detailed description of presently preferred, but nonetheless illustrative, examples of the present alpine ski and snowboard carrying device when taken in conjunction with the accompanying drawings. In this respect, before explaining the current examples of the present alpine ski and snowboard carrying device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the alpine ski and snowboard carrying device. It is therefore important that the claims be regarded as including such equivalent constructions insofar as they do not depart from the spirit and scope of the present invention.

Objects of the present alpine ski and snowboard carrying device, along with various novel features that characterize the invention are particularly pointed out in the claims forming a part of this disclosure. For better understanding of the alpine ski and snowboard carrying device, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
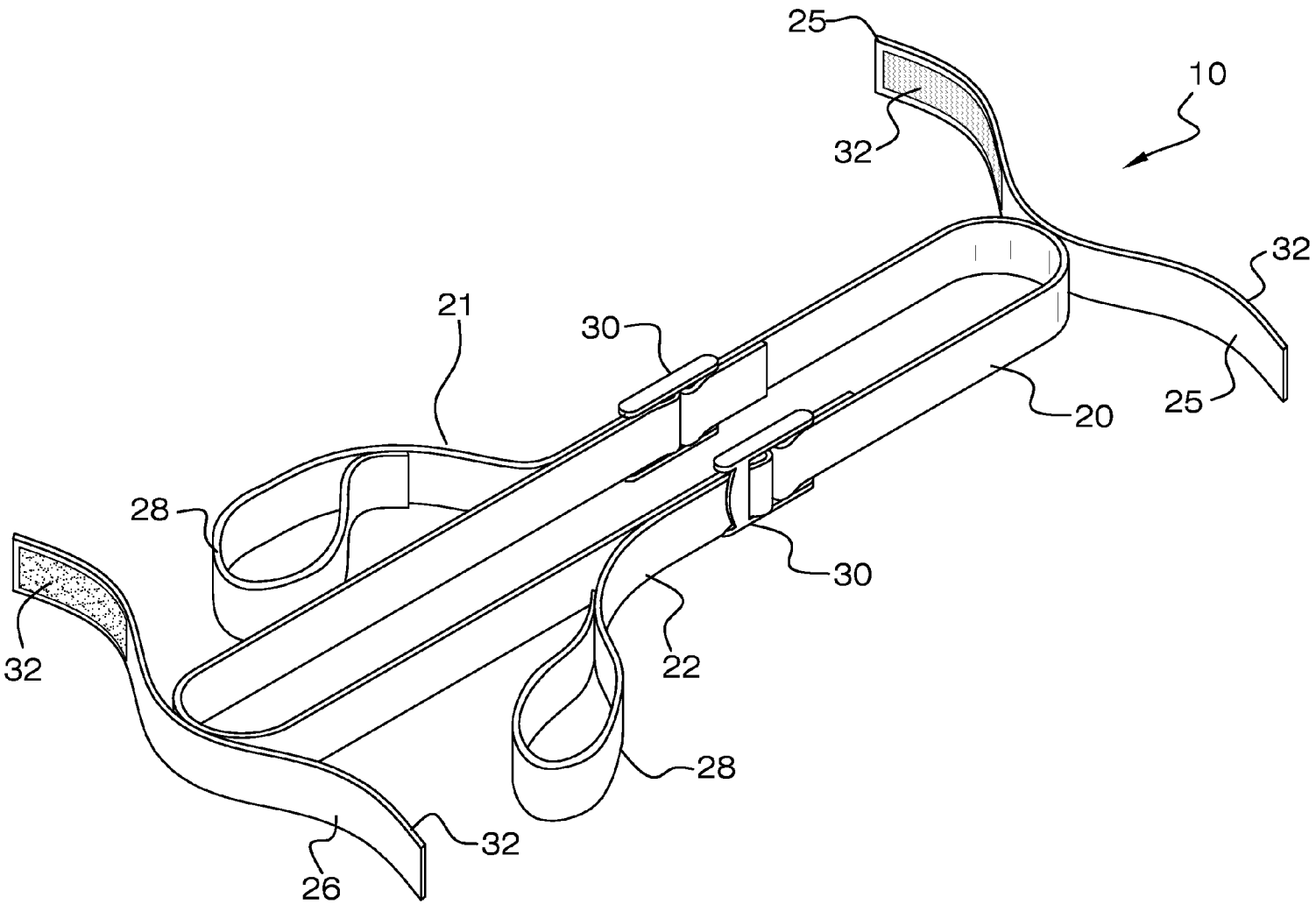
FIG. 1 is a front perspective view.

With reference now to the drawings, and in particular FIGS. 1 through 8 thereof, example of the instant alpine ski and snowboard carrying device employing the principles and concepts of the present alpine ski and snowboard carrying device and generally designated by the reference number 10 will be described.

Referring to FIGS. 1 through 8, a preferred embodiment of the present alpine ski and snowboard carrying device 10 is illustrated. The present alpine ski and snowboard carrying device 10 includes an elongated slidingly adjustable supporting first strap 20 and an elongated adjustable supporting second strap 22. The supporting second strap 22 is slidably connected to the supporting first strap 20. An adjustable first end strap 24 is attached to the supporting first strap 20, and an adjustable second end strap 26 is attached to the supporting second strap 22. The supporting second strap 22 is longer than the supporting first strap 20. Each of first end strap 24 and the second end strap 26 have a securement portion 32 on opposite distal ends 25 thereof. The securement portion 32 may be formed of hook and loop fastening. An end loop 28 is disposed on outer ends 21 of the supporting second strap 22. A pair of slider-type buckles 30 is disposed endwise upon the supporting first strap 20. The pair of slider-type buckles 30 adjusts the length of the supporting first strap 20 therethrough relative the supporting second strap 22. The present device 10 also includes a pair of elongated extension members 86. Each extension member 86 attaches to the secruement portion 32 of each of the first end strap 24 and the second end strap 26. The extension members 86 extend the length of the securement portion 32 for utilization of the device 10 to carry a snowboard 80. The extension members 80 are formed of hook and loop fastening.

Figure 2:
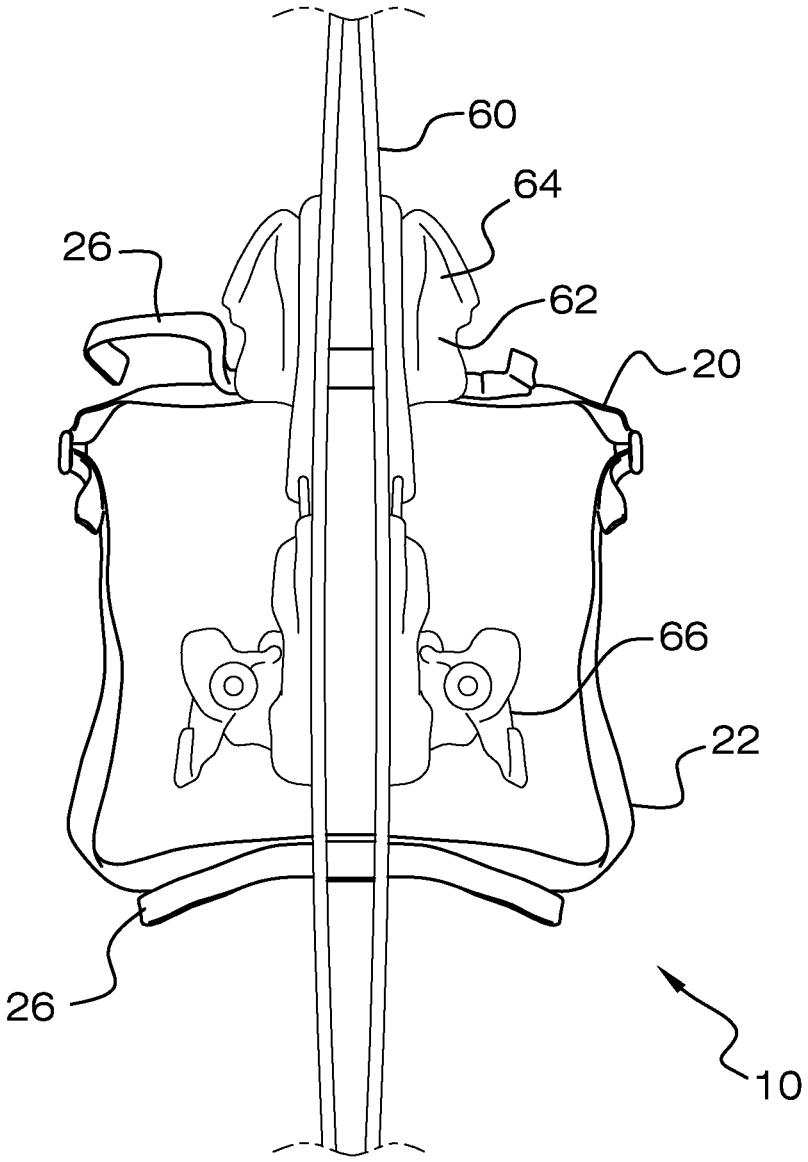
FIG. 2 is an in-use front elevation illustrating a pair of alpine snow skis centered atop the device.
Figure 3:
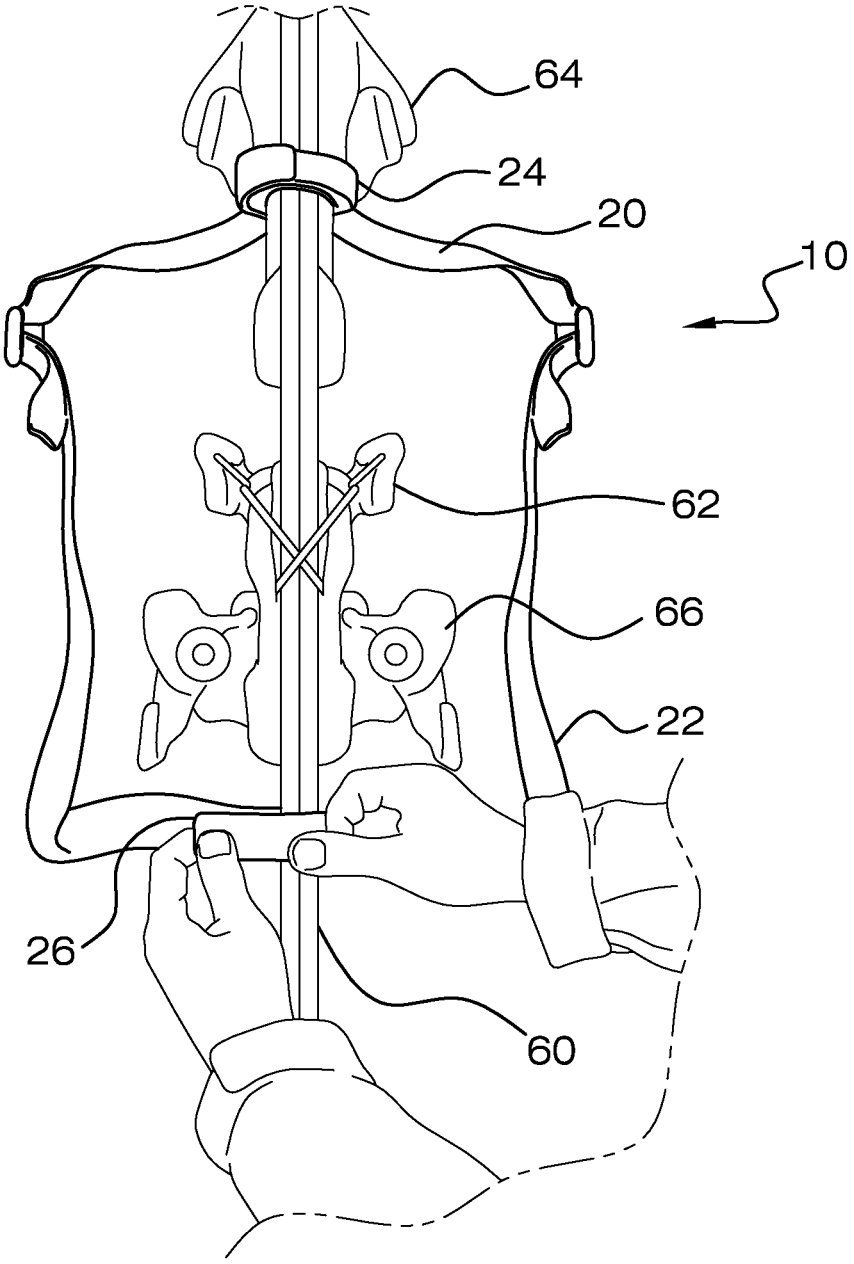
FIG. 3 is an in-use side elevation view illustrating a pair of alpine snow skis secured within the device.
Figure 4:
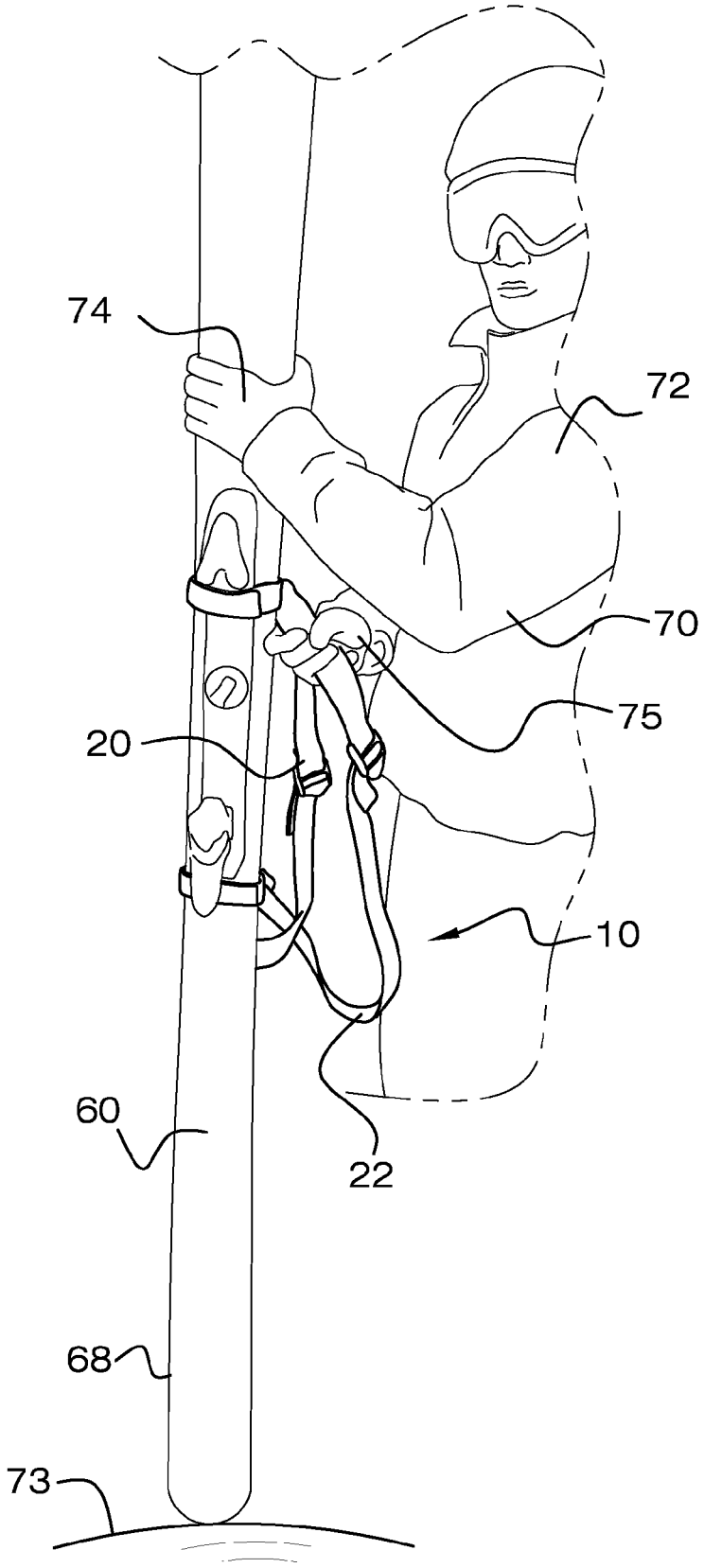
FIG. 4 is an in-use front perspective view illustrating a pair of alpine snow skis secured within the device and in position to don.
Figure 5:
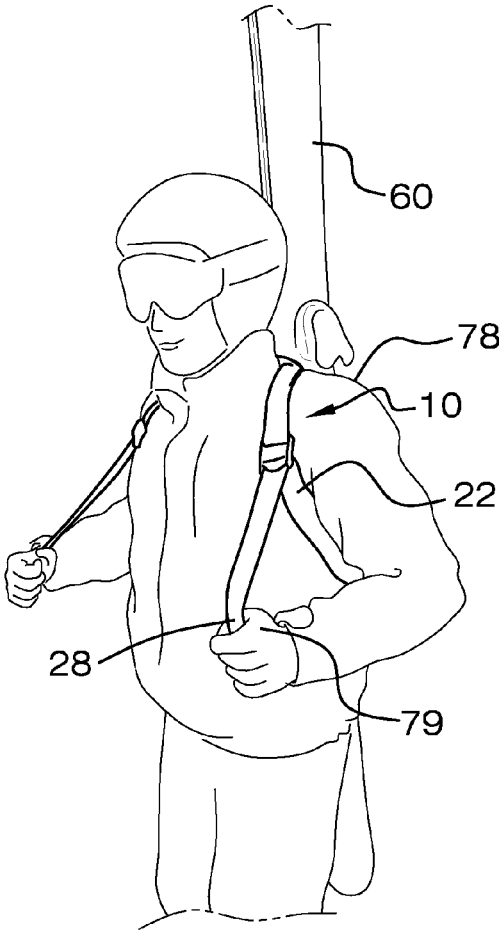
FIG. 5 is an in-use front perspective view illustrating the present device being worn while securing a pair of alpine snow skis therein.
Figure 6:
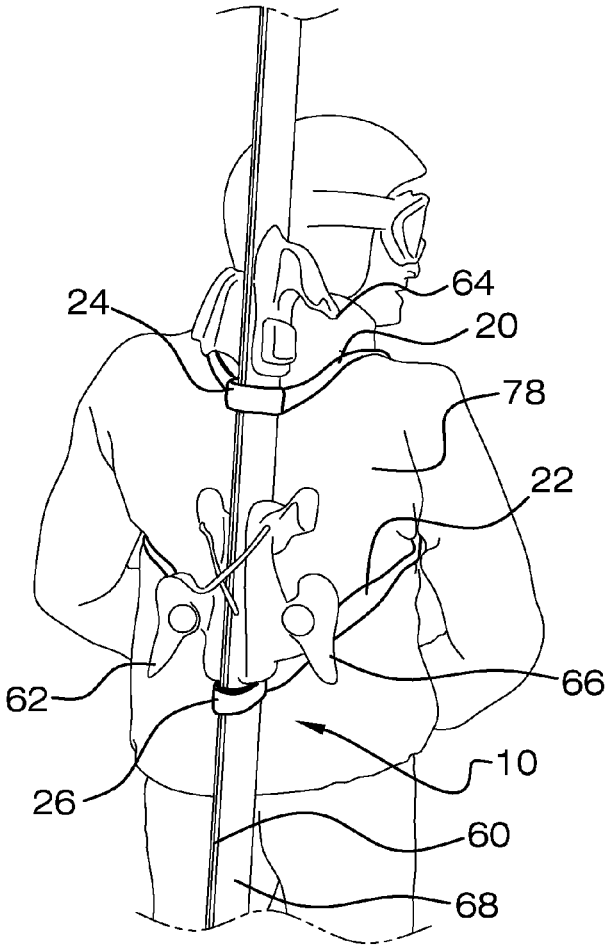
FIG. 6 is an in-use rear elevation view illustrating the present device being worn while securing a pair of alpine snow skis therein.
Figure 7:
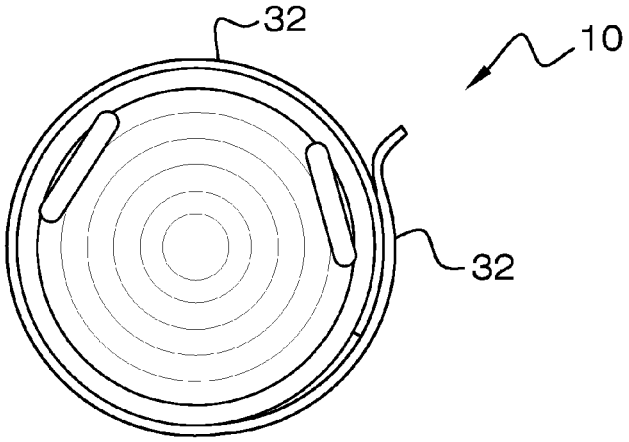
FIG. 7 is a side elevation in a rolled-up position.
Figure 8:
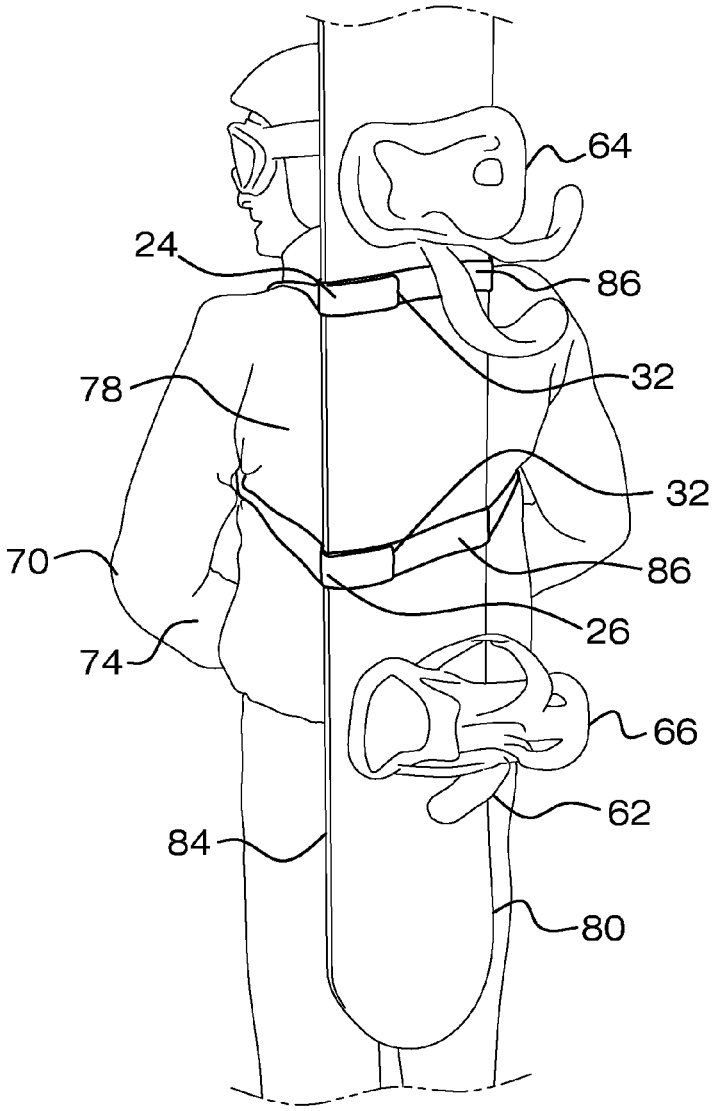
FIG. 8 is an in-use isometric view illustrating use for carrying a snowboard.

Use:

Use of the present device 10 to carry a pair of skis 60 starts with unrolling the device from a rolled-up position, shown in FIG. 7, by pulling the first end strap 24 and the second end strap 26 apart. As shown in FIG. 1, the device 10 is laid out on a flat surface in a position wherein the first end strap 24 is parallel to the second end strap 26 with both the first end strap 24 and the second end strap 26 being open and facing up, and the supporting first strap 20 is parallel to the supporting second strap 22 forming an elongated rectangular shape, whereby the device 10 is placed into a ski attachment position. The supporting first strap 20 and second strap 22 must be untangled and untwisted to ensure proper attachment of the skis 60 to the device 10 and to ensure a proper mounting position on a user's 70 shoulders 72. As shown in FIG. 2, after the device 10 is placed into a ski attachment position, a pair of skis 60 are placed into a securement position wherein the skis 60 are positioned parallel to each other with bindings 62 facing outwardly, the bottoms 63 of the skis 60 adjacent, and a heel piece 64 of one of the bindings 62 aligned with and disposed in a parallel position to the heel piece 64 of other binding 62. The pair of skis 60 is centrally placed over the first end strap 24 and second end strap 26, which are open and facing upwardly. The skis 60 are perpendicular to the first and second end straps 24, 26. The toe piece 64 of each of the bindings 62 of the skis 60 is placed into position just above the first end strap 24. The heel piece 66 of the bindings 62 of the skis 60 is placed into position just above the second end strap 26. As shown in FIG. 3, with the skis 60 squeezed together in parallel position and the bindings 62 facing away from each other, the first end strap 24 and second end strap 26 are wrapped around and securely tightened just below the toe piece 64 and heel piece 66 by fastening the securement portions 32 together, respectively thereby placing the skis 60 into a wrapped position. As shown in FIG. 4, the user 70 then lifts the pair of skis 60, secured in the wrapped position, upwardly and rests the tail 68 of each ski 60 on the flat surface 73, with the pair of skis 60 held in one of the user's 70 hands 74 and the first strap 20 and second strap 22 being held away from and parallel to the pair of skis 60 by the user's 70 opposite hand 75. Then, the user 70 grasps the pair of skis 60 with one hand 74 just above the toe piece 64 of the bindings 62 and lifts the pair of skis 60 off the ground. As shown in FIG. 5, the user 70 puts each arm 74, 75 through an opposite one of the first strap 20 and second strap 22 as in donning a backpack thereby placing the pair of skis 60 in a vertical position behind the user's 70 back 78. The user 70 adjusts the tightness of the supporting first strap 20 and second strap 22 by pulling down on each of the end loops 28 thereby placing the pair of skis 60 in a carrying position. Placing the user's 70 thumbs 79 through the end loops 28, as shown in FIG. 5, and pulling downwardly tightens the first and second straps 20, 22 to achieve a secure, balanced vertical position of the skis 60 behind a user's 70 back. By adjusting the length utilizing the slider-type buckle 30, a user 70 may alternatingly shorten and lengthen the supporting first strap 20 and the supporting second strap 22 to tighten and loosen, respectively, the supporting first strap 20 and the supporting second strap 22 thereby securing the pair of skis 60 into the vertical position and removing the pair of skis, respectively.

To remove the pair of skis 60 from the carrying position using the device 10, the user 70 loosens the device 10 by pushing up on the slider-type buckle 30 disposed on each of the first strap 20 and second strap 22 and sliding each buckle 30 toward the end loops 28, thereby allowing slack in the first strap 20 and second strap 22. The user removes the first strap 20 and second strap 22 from the user's 70 shoulders 78. The user 70 lays the pair of skis 60 on a flat surface 73 and removes the pair of skis 60 from the first end and second end straps 24, 26 by pulling on and releasing the securement portion 32 thereon. As shown in FIG. 7, the user 70 places the device in a rolled-up position for storage by starting with the first strap 20 adjacent to the securement portion 32 of the first strap 20 and wrapping the device 10 into a roll, folding the device 10 over itself wherein the securement portions 32 are wrapped around the rolled up device 10 to secure the device 10 into a rolled-up position whereupon the device 10 may be stowed in the user's 70 ski jacket pocket so that the device 10 may be conveniently used again to carry a pair of skis 60.

For use with a snowboard 80, the user follows essentially the same method as for utilizing the device 10 with a pair of skis 60. The user 70 starts by pulling the first end strap 24 away from the second end strap 26. This is followed by positioning the first end strap 24 on a flat surface in a position parallel to the second end strap 26, wherein each of the first end strap 24 and the second end strap 26 are open and facing upwardly and positioning the supporting first strap 20 in a position parallel to the supporting second strap 22, wherein the positioning of the first end strap 24, the second end strap 26, the supporting first strap 20 and the supporting second strap 22 form an elongated rectangular shaped snowboard attachment position. Next, the user 70 lays out the supporting first strap 20 and the supporting second strap 22 in an untangled and untwisted position whereby proper attachment of the snowboard 80 and a proper mounting position on a user's 70 shoulders 72 is promoted. Then, the user lengthens the first end strap 24 and the second end strap 26 by removably attaching an extension member 86 to one of each of the first end strap 24 securement portions 32 and one of the second end strap 26 securement portions 32, whereby the first end and second end straps 24, 26 accommodate the securing of a snowboard 80 therein. Afterwards, the user 70 places the snowboard 80 in a securement position centrally over the first end strap 24 and second end strap 26, the first end strap 24 and the second end strap 26 being in an open, upwardly facing position wherein the snowboard 80 is perpendicular to both of the first end strap 24 and the second end strap 26, a base 82 of the snowboard 80 faces the first end strap 24 and the second end strap 26 and the bindings 62 face away from the first end strap 24 and the second end strap 26. The user then places the toe piece 64 of the snowboard into a position just above the first end strap 24 and the heel piece 66 of the bindings 62 into a position just above the second end strap 26. The use continues by placing the snowboard 80 into a wrapped position by wrapping the first end strap 24 and the second end strap 26 around the snowboard 80 just below the toe piece 64 and the heel piece 66, respectively, and tightening the first end strap 24 and the second end strap 26 by fastening the extension member 86 to one of the securement portions 32. The user 70 then lifts the snowboard 80 secured in the wrapped position upwardly and resting the tail 68 of the snowboard 80 on a flat surface 73. Next, the user 70 holds the snowboard 80 in one hand while holding the supporting first strap 20 and supporting second strap 22 away from and parallel to the snowboard 80 with the other hand. Then, grasping the snowboard 80 with one hand placed just above the toe piece 64 of the bindings 62, the user 70 lifts the snowboard 80 off the flat surface 73. The method of using the present device 10 for a snowboard 80 continues by putting each arm 74, 75 through an opposite one of the supporting first strap 20 and supporting second strap 22 and then placing the snowboard 80 in a vertical position behind the user's 70 back 78. The user 70 then adjusts the tightness of the supporting first strap 20 and the supporting second strap 22 by pulling down on each of the end loops wherein the snowboard is placed in a carrying position. Then, placing the user's 70 thumbs through the end loops 28 and pulling downwardly and tightening the supporting first strap 20 and supporting second strap 22, the snowboard is placed in a secure, balanced vertical position behind the user's 70 back 78. Alternatingly shortening and lengthening the supporting first strap 20 and the supporting second strap 22, tightens and loosens the supporting first strap 20 and the supporting second strap 22 by adjusting the length utilizing the slider-type buckle 30, whereby the snowboard 80 is alternatingly secured into the vertical position and removed from the device 10, respectively. The removal of the snowboard 80 from the carrying position is accomplished by performing the donning of the device 10 with the snowboard 80 in reverse, utilizing the same method as the method of removing of a pair of skis 60.

The present device 10 supporting first strap 20 and supporting second strap 22 are each formed of 1½ inch nylon webbing. Each of slider-type buckles 30 have a height of 1½ inches and may be formed of high density plastic. The first end and second straps 24, 26 are formed of 1-inch nylon webbing. The first strap 20 has a length in a range from 23 inches to 26 inches and the second strap 22 has a length in a range from 62 inches to 68 inches. The first end strap 24 has a length of approximately 18 inches and the second end strap 26 has a length of approximately 16 inches. Each securement portion 32 may have a length in a range of 5 to 7 inches.

With respect to the above description then, it is to be realized that the optimum dimensional relationships for the parts of the present alpine ski and snowboard carrying device to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An alpine ski and snowboard carrying device comprising:

a pair of skis having a toe piece of a binding and a heel piece of the binding and, alternately, a snowboard having a pair of bindings comprising a rear binding and a forward binding;

a supporting first strap;

a supporting second strap slidably connected to the first strap, the supporting second strap having a length longer than a supporting first strap length;

a first end strap attached to the first strap;

a second end strap attached to the second strap;

a securement portion disposed on opposite distal ends of each of the first end strap and the second end strap;

an end loop disposed on each end of the supporting second strap;

a pair of slider-type buckles disposed endwise upon the supporting first strap connecting the second strap to the first strap, said pair of slider-type buckles disposed to adjust the length of the supporting second strap therethrough when each end loop is pulled;

an elongated extension member removably attachable to the securement portion of each of the first end strap and the second end strap, said extension member additional thereto to extend the length of each securement portion suitable for fastening around a snowboard;

the first end strap and the second end strap releasably attached to an underside of the respective toe piece and the heel piece of the pair of skis and alternately to an underside of the respective rear binding and forward binding of the snowboard, wherein upon the releasable attachment of the first end strap and the second end strap to the underside of the respective toe piece and heel piece of the pair of skis and alternately to the underside of the respective rear binding and forward binding of the snowboard, the first end strap and the second end strap configured to tension about the pair of skis and alternately the snowboard.

2. The alpine ski and snowboard carrying device of claim 1 wherein the securement portion and each extension member are formed of hook and loop fastening.

3. A method of utilizing the alpine ski and snowboard carrying device of claim 1 wherein the method comprises:

pulling the first end strap away from the second end strap;

positioning the first end strap on a flat surface in a position parallel to the second end strap, wherein each of the first end strap and the second end strap are open and facing upwardly;

positioning the supporting first strap in a position parallel to the supporting second strap, wherein the positioning of the first end strap, the second end strap, the supporting first strap and the supporting second strap comprises an elongated rectangular shaped ski attachment position;

laying out the supporting first strap and the second strap in an untangled and untwisted position whereby proper attachment of the skis and a proper mounting position on a user's shoulders is promoted;

placing a pair of skis into a securement position wherein the skis are positioned parallel to each other with bindings facing outwardly, the ski bottoms are adjacent to each other, and a heel piece of one of the bindings is aligned with and disposed in a parallel position to the heel piece of the other binding;

placing the pair of skis in the securement position centrally over the first end strap and second end strap, the first end strap and the second end strap being in an open, upwardly facing position wherein the pair of skis is perpendicular to both of the first end strap and the second end strap;

placing the toe piece of the bindings into a position just above the first end strap;

placing the heel piece of the bindings into a position just above the second end strap;

placing the pair of skis into a wrapped position by squeezing the pair of skis together in parallel position with the bindings facing away from each other, wrapping the first end strap and the second end strap around the skis just below the toe piece and the heel piece, respectively, and tightening the first end strap and the second end strap by fastening the securement portions to each other;

lifting the pair of skis secured in the wrapped position upwardly and resting the tail of each of the pair of skis on a flat surface;

holding the pair of skis in one hand while holding the supporting first strap and the supporting second strap away from and parallel to the pair of skis with the other hand;

grasping the pair of skis with one hand placed just above the toe piece of the bindings and lifting the pair of skis off the flat surface;

putting each arm through an opposite one of the supporting first strap and the supporting second strap and then placing the pair of skis in a vertical position behind the user's back;

adjusting the tightness of the supporting first strap and second strap by pulling down on each of the end loops wherein the pair of skis are placed in a carrying position;

placing the user's thumbs through the end loops and pulling downwardly and tightening the first and second straps wherein the pair of skis are placed in a secure, balanced vertical position behind the user's back; and alternatingly shortening and lengthening the supporting first strap and the supporting second strap and tightening and loosening the supporting first strap and the supporting second strap by adjusting the length utilizing the slider-type buckle, whereby the pair of skis are alternatingly secured into the vertical position and removed, respectively.

4. The method of claim 3 further comprising:

initiating removal of the pair of skis from the carrying position by loosening the first strap and the second strap by pushing upwardly on the slider-type buckle disposed on each of the first strap and second strap and sliding each buckle toward the end loop;

removing the first strap and second strap from the user's shoulders;

placing the pair of skis on a flat surface and removing the pair of skis from the first end strap and second end strap by pulling on and releasing the securement portion thereon;

starting with the first strap adjacent to the securement portion of the first strap, wrapping the device into a roll; and folding the device over itself wherein the securement portions are wrapped around the rolled up device and the device is secured into a rolled-up position.

5. A method of utilizing the alpine ski and snowboard carrying device of claim 1 wherein the method comprises:

pulling the first end strap away from the second end strap;

positioning the first end strap on a flat surface in a position parallel to the second end strap, wherein each of the first end strap and the second end strap are open and facing upwardly;

positioning the supporting first strap in a position parallel to the supporting second strap, wherein the positioning of the first end strap, the second end strap, the supporting first strap and the supporting second strap comprises an elongated rectangular shaped snowboard attachment position;

laying out the supporting first strap and the second strap in an untangled and untwisted position whereby proper attachment of the snowboard and a proper mounting position on a user's shoulders is promoted;

removably attaching an extension member to one of each of the first end strap and second end strap securement portions whereby the first end strap and the second end strap are lengthened to secure a snowboard;

placing the snowboard in a securement position centrally over the first end strap and the second end strap, the first end strap and the second end strap being in an open, upwardly facing position wherein the snowboard is perpendicular to both of the first end strap and the second end strap, a base of the snowboard faces the first end strap and the second end strap and the bindings face away from the first end strap and the second end strap;

placing the toe piece of each of the bindings into a position just above the first end strap;

placing the heel piece of the bindings into a position just above the second end strap;

placing the snowboard into a wrapped position by wrapping the first end strap and the second end strap around the snowboard just below the toe piece and the heel piece, respectively, and tightening the first end strap and the second end strap by fastening the extension member to one of the securement portions of each of the first end strap and the second end strap to each other;

lifting the snowboard secured in the wrapped position upwardly and resting the tail of the snowboard on a flat surface;

holding the snowboard in one hand while holding the first strap and second strap away from and parallel to the snowboard with the other hand;

grasping the snowboard with one hand placed just above the toe piece of the bindings and lifting the snowboard off the flat surface;

putting each arm through an opposite one of the first strap and second strap and then placing the snowboard in a vertical position behind the user's back;

adjusting the tightness of the supporting first strap and the supporting second strap by pulling down on each of the end loops wherein the snowboard is placed in a carrying position;

placing the user's thumbs through the end loops and pulling downwardly and tightening the first and second straps wherein the snowboard is placed in a secure, balanced vertical position behind the user's back; and alternatingly shortening and lengthening the supporting first strap and the supporting second strap and tightening and loosening the supporting first strap and the supporting second strap by adjusting the length utilizing the slider-type buckle, whereby the snowboard is alternatingly secured into the vertical position and removed, respectively.

6. The method of claim 5 further comprising:

initiating removal of the snowboard from the carrying position by loosening the first strap and the second strap by pushing upwardly on the slider-type buckle disposed on each of the first strap and second strap and sliding each buckle toward the end loop;

removing the first strap and second strap from the user's shoulders;

placing the snowboard on a flat surface and removing the snowboard from the first end strap and second end strap by pulling on and releasing the extension member from the securement portion thereon;

starting with the first strap adjacent to the securement portion of the first strap, wrapping the device into a roll; and folding the device over itself wherein the securement portions are wrapped around the rolled up device and the device is secured into a rolled-up position.

* * * * *